US006007054A

United States Patent [19]

Kobayasi et al.

[11] Patent Number: 6,007,054

[45] Date of Patent: Dec. 28, 1999

[54] HAND OPERATED CHAIN BLOCK HAVING AN IMPROVED COVER

[75] Inventors: Eikiti Kobayasi; Yosiaki Okamoto, both of Osaka, Japan

[73] Assignee: Elephant Chain Block Co., Ltd., Osaka, Japan

[21] Appl. No.: 09/071,812

[22] Filed: May 4, 1998

[30] Foreign Application Priority Data

May 15, 1997 [JP] Japan ..... 9-125185

[51] Int. Cl.[6] ..... B66D 1/30

[52] U.S. Cl. ..... 254/372; 254/346

[58] Field of Search ..... 254/346, 352, 254/365, 372, 376

[56] References Cited

U.S. PATENT DOCUMENTS

| | | | |
|---|---|---|---|
| 3,626,499 | 12/1971 | Iwama et al. | 254/346 X |
| 3,894,720 | 7/1975 | Koji | 254/372 X |
| 5,149,058 | 9/1992 | Nishimura | 254/372 X |
| 5,421,553 | 6/1995 | Hashiue | 254/346 |
| 5,544,863 | 8/1996 | Ueno et al. | 254/372 X |
| 5,641,151 | 6/1997 | Kataoka | 254/372 X |
| 5,647,576 | 7/1997 | Kataoka | 254/372 X |

FOREIGN PATENT DOCUMENTS 51-40224 10/1976 Japan .

*Primary Examiner*—Donald P. Walsh
*Assistant Examiner*—Emmanuel M. Marcelo
*Attorney, Agent, or Firm*—Dickstein Shapiro Morin & Oshinsky LLP

[57] ABSTRACT

To provide a hand operated chain block capable of facilitating the fitting of the brake cover to the related side plate without worsening the appearance of the chain block, a brake cover is provided, at a marginal portion therearound, with a flange portion extending outwardly in the same direction as one side plate to abut with the one side plate, and the flange portion is provided, at a marginal portion therearound, with recesses fittable to the stay bolts. The recesses are brought into engagement with the related stay bolts by fitting the recesses to the related stay bolts, thus enabling the brake cover to be easily fixed in place and also be prevented from being disengaged from the one side plate accidentally.

5 Claims, 5 Drawing Sheets

HAND OPERATED CHAIN BLOCK HAVING AN IMPROVED COVER

BACKGROUND OF THE INVENTION

1. Field of the Invention

The present invention relates to a hand operated chain block and, more particularly, to a hand operated chain block wherein a load sheave is rotationally driven by pulling a hand chain passing over a hand wheel, so as to wind up and down a load chain passing over the load sheave.

2. Description of the Prior Art

In general, a hand operated chain block of this type includes a load sheave supported between a pair of side plates via bearings; a hand wheel disposed at the outside of one side plate, so as to drive the load sheave through a drive shaft; and a mechanical brake interposed between the load sheave and the hand wheel. A hand wheel is rotationally driven by pulling a hand chain passing over the hand wheel, to cause the load sheave to be driven via the mechanical brake and the drive shaft, whereby the load chain is wound up and down to hoist up and down a load suspended from a hook.

Usually, this conventional type of chain block is provided with a wheel cover for covering the hand wheel and a brake cover for covering the mechanical brake, for the purpose of protecting the hand wheel and the mechanical brake from external environment and giving a good appearance to the chain block. In general, the wheel cover and the brake cover are separately fitted to the related side plate with fixture such as bolts. Japanese Published Patent No. Sho 51(1976)-40224 discloses that a flange extending outwardly in the same direction as the related side plate is formed along a marginal portion around the brake cover, so as to be sandwiched between the related side plate and the wheel cover and is fixedly held therebetween by tightening stay bolts for fitting the wheel cover.

However, for fitting the wheel cover and the brake cover fitted to the related side plate separately with fixture such as bolts, it takes time involving troublesome labor and also increased parts account is needed because of the fixture such as bolts being needed for each of the wheel cover and the brake cover.

In addition, the fixedly holding of the flange of the brake cover between the side plate and the wheel cover disadvantageously worsens the appearance, because the marginal portion of the brake cover is laid bare between the marginal portion around the side plate and the marginal portion around the wheel cover, when viewed from outside.

SUMMARY OF THE INVENTION

To solve the above-described problems, the present invention has been made, with the aim to provide a hand operated chain block capable of facilitating the fitting of the brake cover to the related side plate without worsening the appearance of the chain block.

The present invention is directed to a novel hand operated chain block comprising a load sheave supported between a pair of side plates via bearing means; a hand wheel, located at an outside of one side plate, for driving the load sheave via a drive shaft; a mechanical brake interposed between the load sheave and the hand wheel; a wheel cover, fitted to the one side plate with a plurality of stay bolts, for covering the hand wheel; and a brake cover, fitted to the one side plate, for covering the mechanical brake, wherein the brake cover is provided, at a marginal portion therearound, with a flange portion extending outwardly along the same direction as the one side plate to abut with the one side plate, and the flange portion is provided, at a marginal portion therearound, with recesses fittable to the stay bolts.

With this arrangement, in which the flange portion formed in the marginal portion around the brake cover is provided with recesses fittable to the stay bolts, it is simply required for attaching the brake cover to the side plate that the recesses are brought into engagement with the related stay bolts by fitting the recesses to the related stay bolts. This enables the brake cover to be easily fixed in place and also be prevented from being disengaged from the one side plate accidentally. Thus, the simple attachment of the brake cover can be provided without using specific fixture such as bolts. In addition, the flange portion of the brake cover is not held in sandwich relation between the one side plate and the wheel cover, so that when the concerned part is viewed from outside, only the marginal portion of the one side plate and the marginal portion of the wheel cover are exposed but no marginal portion of the brake cover is exposed therebetween, and accordingly, the appearance can be well maintained.

According to the present invention, it is preferable that the wheel cover is provided with legs to be fitted to the one side plate, and the marginal portion around the flange portion of the brake cover is abutted with inner wall surfaces of the legs. By allowing the marginal portion around the flange portion to be held by the legs of the wheel cover as well, with its being abutted with the inner wall surfaces of the legs, the fitting of the brake cover to the side plate is further ensured.

According to the present invention, it is preferable that the legs are each provided, at a free end portion thereof, with an abutting portion extending along the same direction as the one side plate to abut with the one side plate. By virtue of the abutting portions being formed at the free end portions of the wheel cover, the fitting of the legs of the wheel cover to the side plate is further ensured, so that the marginal portion around the brake cover abutting with the inner wall surfaces of the legs is further surely held by the legs. Consequently, the fitting of the brake cover to the side plate can be further ensured.

Also, according to the present invention, it is preferable that the abutting portion is formed by bending the free end portion of the each leg and also the bent portion is formed into a curved form, so as to allow the marginal portion around the flange portion to abut with the bent portion. This arrangement, in which the abutting portion is formed by bending the free end portion of the each leg into a curved form, so as to allow the marginal portion around the flange portion to abut with the bent portion, involves the curved parts at the bending portions having a given width with respect to the direction for the marginal portion around the flange portion to be abutted with the inner wall surfaces of the legs. By virtue of this, the marginal portion around the flange portion and the inner wall surfaces of the legs can be allowed to well abut with each other within the widths of the curved parts, even when the marginal portion around the flange portion does not accurately contact with the inner wall surfaces of the legs due to, for example, some manufacturing error involved in the wheel cover and the brake cover. Thus, even when some manufacturing error is caused, the marginal portion around the flange portion and the inner wall surfaces of the legs can be well abutted with each other, so that strict design accuracy is not required for the components and accordingly the chain block can be manufactured with reduced costs.

Further, according to the present invention, it is preferable that a projection is provided in any one of the abutting portion at a position close to the stay blots and the one side plate at a position opposite to that position, and a receiving hole for receiving the projection therein is provided in the other. This arrangement, in which a projection is provided in any one of the abutting portion at a position close to the stay bolts and the one side plate at a position opposite to that position and a receiving hole for receiving the projection therein is provided in the other, enables the wheel cover to be fitted to the side plate quickly and surely with positioned in place by fitting the projection into the related receiving hole. This contributes to sure abutment of the marginal portion around the flange portion with the inner wall surface of the leg. In addition to this, the fitting of the projection into the related receiving hole contribute to increase in strength of the leg of the wheel cover, together with the stay bolt close to the projection. Consequently, for example even when the chain block is dropped down on the ground or collides with some objects, the leg is protected from being deformed or being moved out of position, thus enabling the surely fitted brake cover to be well maintained.

BRIEF DESCRIPTION OF THE DRAWINGS

The present invention will now be described with reference to the accompanying drawings wherein.

DETAILED DESCRIPTION OF THE PREFERRED EMBODIMENT

Referring now to the accompanying drawing figures, an example of the preferred embodiment of the invention is described below. It is to be understood, however, that the scope of the invention is by no means limited to the illustrated embodiments.

Figure 1:
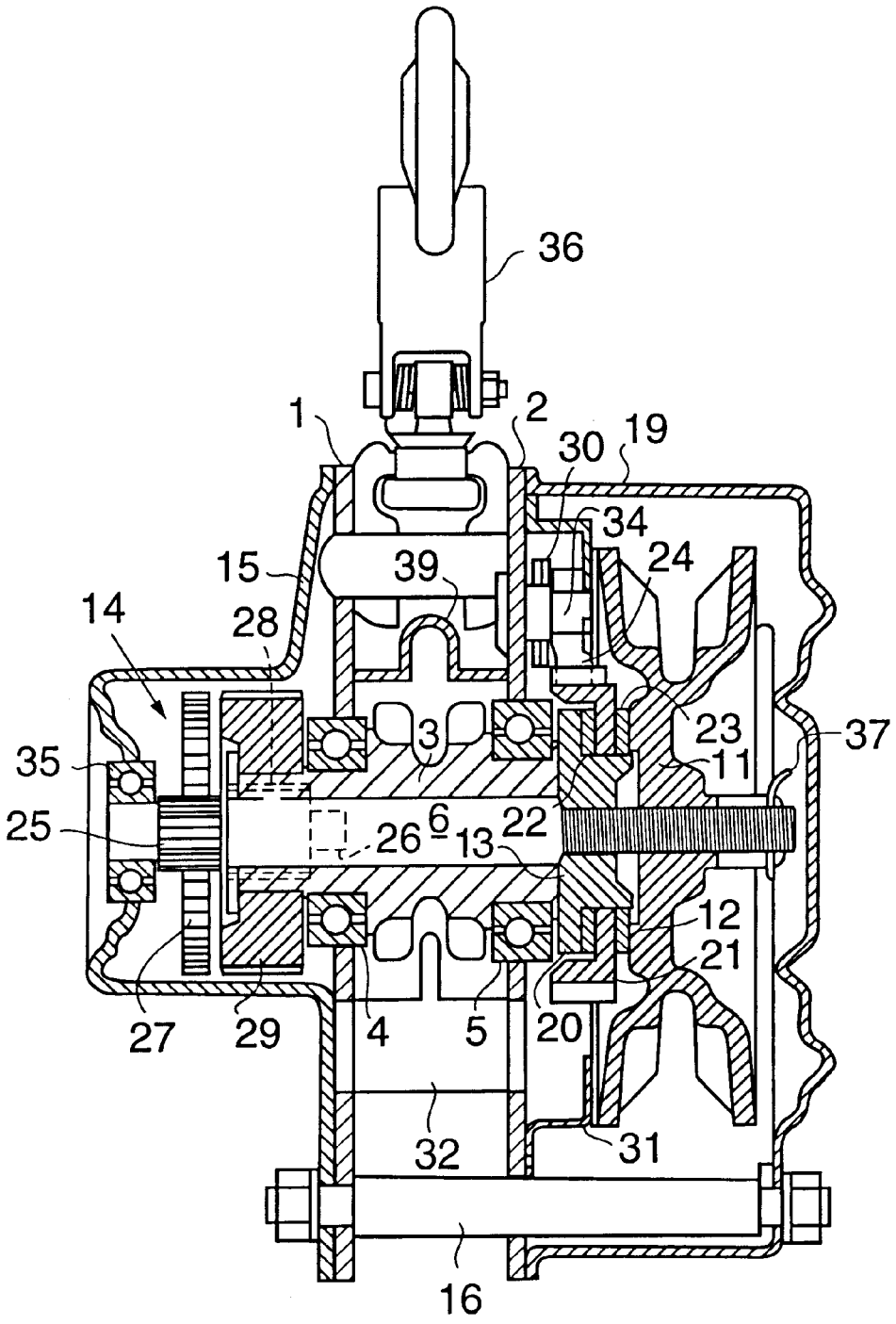
FIG. 1 is a vertical section of the hand operated chain block of an embodied form of the present invention.

FIG. 1 is a vertical section of the hand operated chain block of an embodied form of the present invention. In this hand operated chain block, a load sheave 3, over which a load chain (not shown) passes, is rotatably supported between a pair of spaced apart, opposing, left and right side plates 1, 2 via a pair of bearings 4, 5, and a drive shaft 6 is so inserted in a shaft bore of the load sheave 3 as to be rotatable relative to the load sheave. A hand wheel 11 over which a hand chain (not shown) is wound is threadedly engaged with the drive shaft 6 at one axial end thereof at the outer side of the right side plate 2. A set pin 37 is inserted in the axial end portion of the drive shaft 6. A transmission mechanism 13 including a mechanical brake 12 is provided between the hand wheel 11 and the load sheave 3.

The transmission mechanism 13 comprises: a driven hub 20 which is so connected to the drive shaft 6 as to be non-rotatable relative thereto (connected in a threaded relation thereto in FIG. 1); a reverse rotation stop gear 21 interposed between a flange portion of the driven hub 20 and the hand wheel 11 and rotatably supported by the driven hub 20; and lining plates 22, 23 interposed between the driven hub 20 and the reverse rotation stop gear 21 and between the reverse rotation stop gear 21 and the hand wheel 11, respectively. The right side plate 2 is provided with a pawl shaft 34, to which a reverse rotation stop pawl 24 engageable with the reverse rotation stop gear 21 is swingably fitted. Between the reverse rotation stop gear 24 and the right side plate 2 is interposed a pawl spring 30 biasing the reverse rotation stop pawl 24 toward the reverse rotation stop gear 21. The mechanical brake 12 is composed of the reverse rotation stop pawl 24, the reverse rotation stop gear 21, the driven hub 20, and the lining plates 22, 23.

On the other hand, the drive shaft 6 is supported by a bearing 35 at the other axial end, and a geared reduction mechanism 14 including a plurality of reduction gears is provided between the bearing 35 and load sheave 3 at the outer side of the left side plate 1. The geared reduction mechanism 14 comprises: a first gear 25 formed integrally with an axial end portion of the drive shaft 6; a pair of second gears 27 engaged with the first gear 25 and supported by a pair of intermediate shafts 26; a pair of third gears 28 engaged with the second gears 27 and supported by the pair of intermediate shafts 26 (only each one of the pairs of intermediate shafts 26, second gears 27 and third gears 28 is represented in FIG. 1); and a fourth gear 29 connected to an extension of the load sheave 3 and engaged with the third gears 28.

A gear cover 15 for covering the geared reduction mechanism 14 and a wheel cover 19, opening at one side thereof, for covering the hand wheel 11 are detachably mounted on the outer sides of the left and right side plates 1, 2, respectively, by three stay bolts 16, 17 and 18 connecting the pair of side plates 1, 2 (only one stay bolt 16 is represented in FIG. 1). Interposed between the right side plate 2 and the hand wheel 11 is a brake cover 31 for covering the periphery of the mechanical brake 12. 32 denotes a chain split; 36 a hanging hook for hanging a chain block; and 39 a chain guide.

When the hand wheel 11 is driven in the normal rotation direction by pulling the hand chain 9, the drive shaft 6 is driven through the transmission mechanism 13. The drive of the drive shaft is transmitted to the load sheave 3 through the geared reduction mechanism 14, to rotationally drive the load sheave 3, so that the load chain, passing over the load sheave 3, of loading side, in other words, a portion of the load chain having at the foremost end thereof a hook for suspending a load, is wound up to hoist up the load. The hoisted load is maintained in suspension through the action of the mechanical brake 12.

When the hoisted load is lowered, the hand wheel 11 is driven in reverse by pulling the hand chain. The hand wheel 11 driven in reverse is screwed backwards along the drive shaft, to drive the load sheave 3 in reverse, while the mechanical brake 12 is alternately actuated and deactuated, so as to lower the load gradually.

Figure 2:
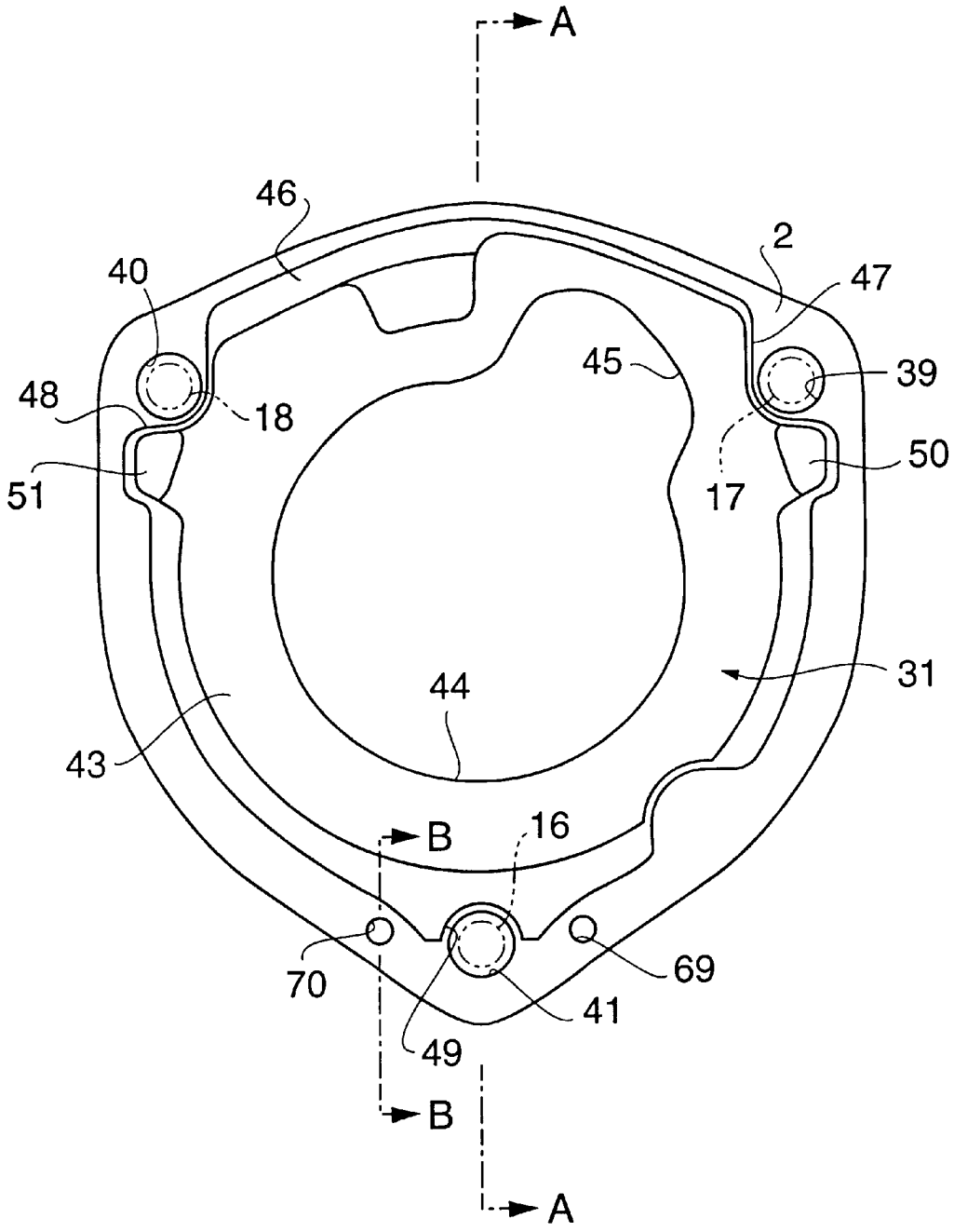
FIG. 2 is a front view showing the state of the brake cover being fitted to the right side plate.
Figure 3:
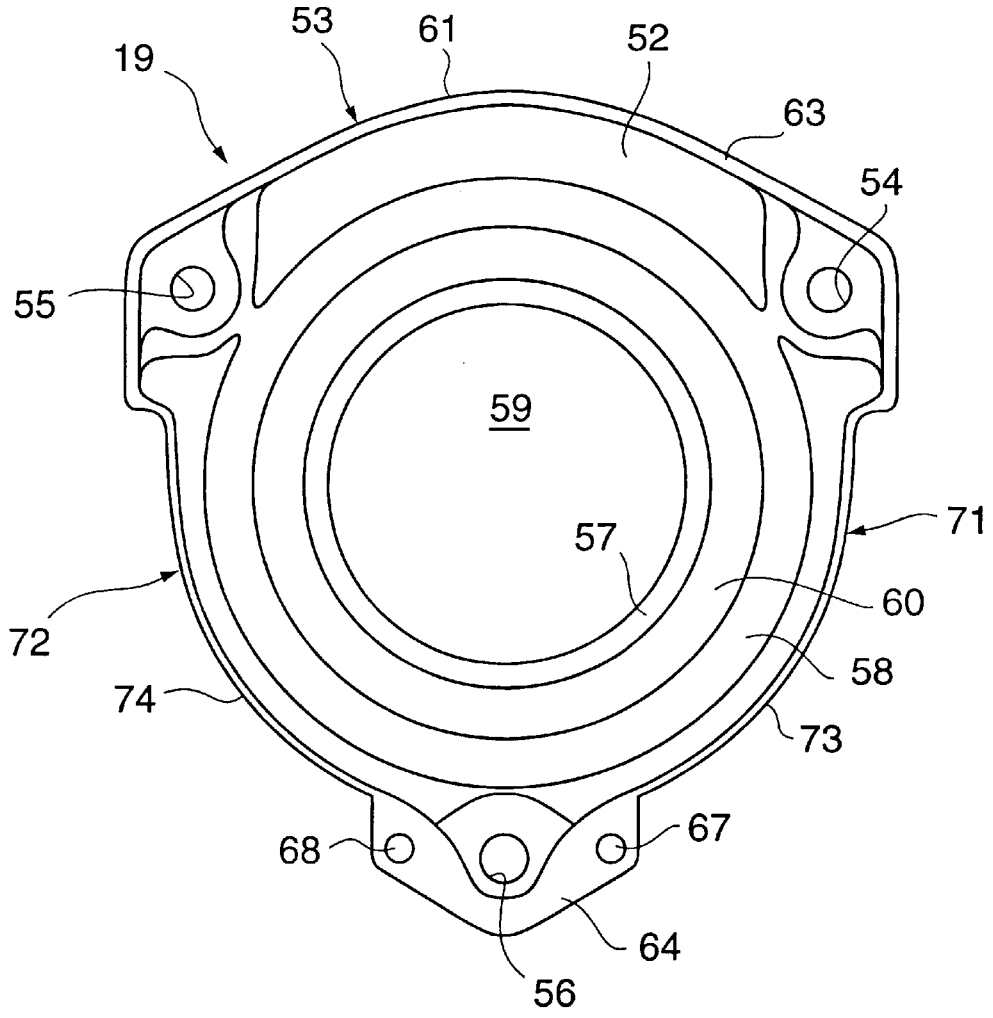
FIG. 3 is a rear view of the wheel cover.
Figure 4:
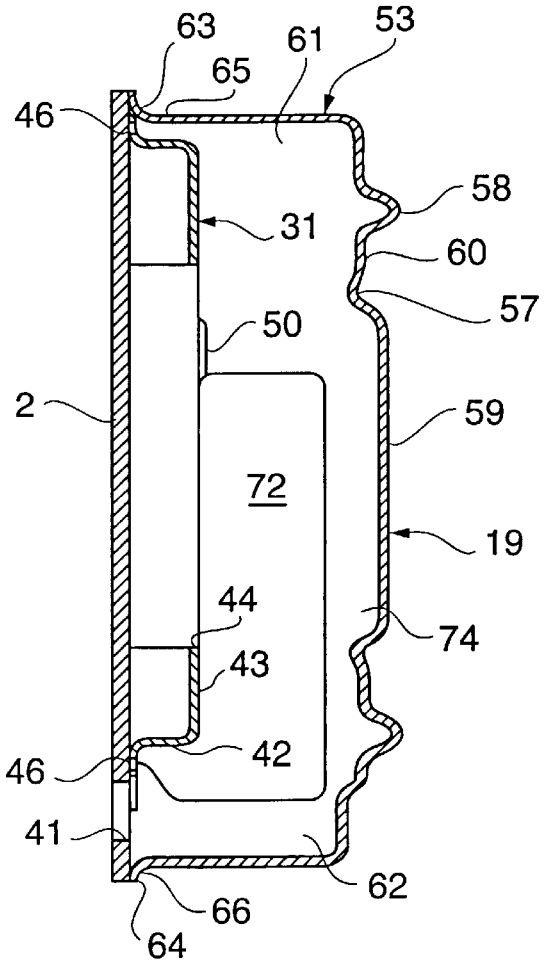
FIG. 4 is a sectional view, when viewed from the sectioning direction to be taken along line IV—IV in FIG. 2, of the state of the brake cover and the wheel cover being fitted to the right side plate.
Figure 5:
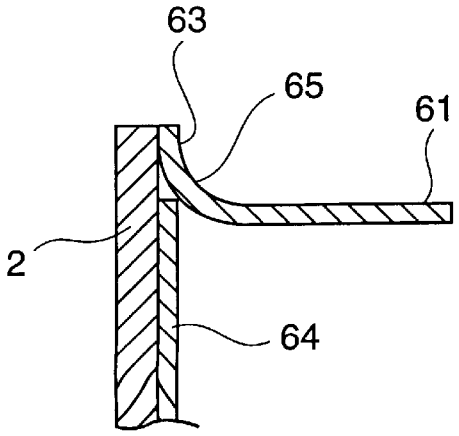
FIG. 5 is a sectional view of the main part, showing the fitting of the brake cover in FIG. 4.
Figure 6:
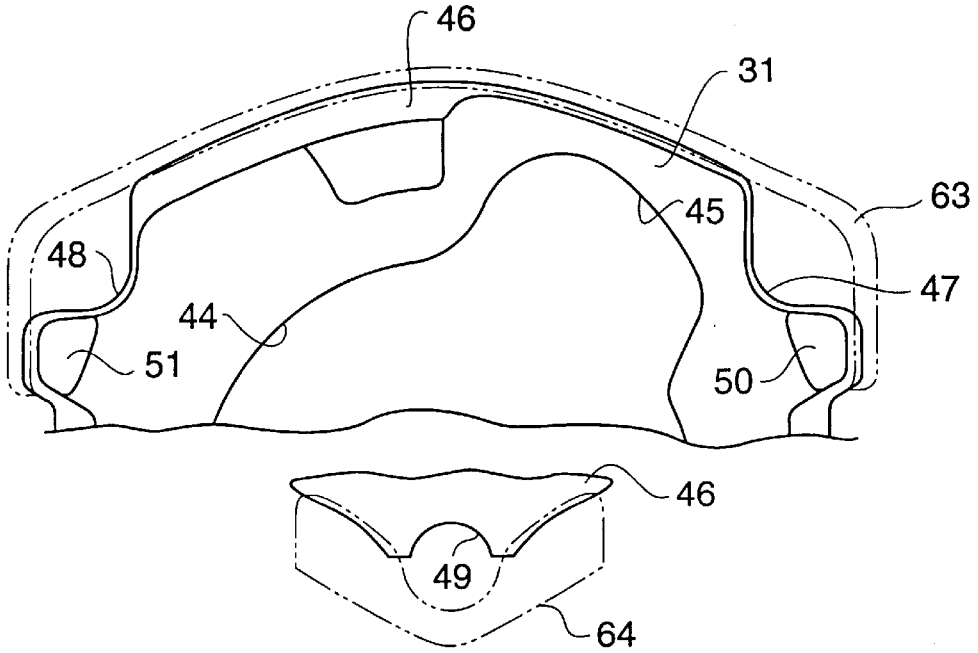
FIG. 6 is a sectional front view of the main part, showing the state of the wheel cover overlapping with the brake cover.

FIG. 2 is a front view showing the state of the brake cover 31 being fitted to the right side plate 2; FIG. 3 is a rear view of the wheel cover 19; FIG. 4 is a sectional view showing the state of the brake cover 31 and the wheel cover 19 being fitted to the right side plate 2 when viewed from the sectioning direction to be taken along line IV—IV of FIG. 2; FIG. 5 is a sectional view of the main part, showing the fitting of an upper portion of the brake cover 31 in FIG. 4; and FIG. 6 is a front view of the main part, showing the state of the wheel cover 19 overlapping with the brake cover 31. The fitting of the brake cover 31 will be described with reference to FIGS. 2 to 6.

As shown in FIGS. 2 and 4, the right side plate 2 has a generally inverted delta shape, with each side protruding at the center part thereof and each corner being rounded. The right side plate has, at its upper corners, insertion bores 39, 40 for two stay bolt 17, 18 to be inserted, and at its lower part, an insertion bore 41 for one stay bolt 16 to be inserted. The brake cover 31 is smaller than the right side plate 2 and has a cylindrical box shape, opening, at one end, to the right side plate 2, comprising a generally cylindrically shaped peripheral wall 42 for covering the periphery of the mechanical brake 12 and a generally circular outer wall 43 for covering an external portion of the mechanical brake 12. The outer wall 43 is provided at a center thereof with a generally circular aperture 44 for allowing lining plate 23 of the mechanical brake 12 to contact with the hand wheel 11. The aperture 44 is provided at an upper portion thereof with a generally rectangular shaped, extended opening 45, formed continuously to the aperture 44 for accommodating therein the reverse rotation stop pawl 24 and others.

A marginal portion around the peripheral wall 42 is bent outwardly in the same direction as the right side plate 2, to form a flange portion 46 for allowing the brake cover 31 to abut with the right side plate 2. Formed in the flange portion 46 at positions corresponding to the positions of the insertion bores 39, 40, 41 bored in the right side plate 2 are generally semi-circular recesses 47, 48, 49 for allowing the three stay bolts 17, 18, 16 to fit therein. The provision of these recesses 47, 48, 49 fittable to the three stay bolts can provide the result that the brake cover 31, when attached to the right side plate 2, can be easily fixed in place by simply fitting the recesses 47, 48, 49 to the related stay bolts 17, 18, 16 to be put into engagement therewith and also is prevented from being disengaged from the right side plate 2 accidentally. Thus, the simple attachment of the brake cover 31 can be provided without using specific fixture such as bolts for fixing the brake cover 31. In addition, the marginal portion 46 of the brake cover 31 is not held in sandwich relation between the right side plate 2 and the wheel cover 19, so that when the concerned part is viewed from outside, only the marginal portions of the right side plate 2 and the wheel cover 19 are exposed but no marginal portion of the brake cover 31 is exposed therebetween, and accordingly, the appearance can be well maintained.

The brake cover 31 is provided, its portions below the two upper recesses 47, 48, with protrusions 50, 51 which are formed by the outside wall 43 being protruded toward the wheel cover 19, to prevent the hand chain from running into a space between the wheel cover 19 and the brake cover 31 during the pulling operation of the hand chain.

Although the recesses 47, 48, 49 are formed for the three stay bolts 17, 18, 16 in this embodiment, it is essential for fixing the brake cover in position that the recesses are held by engagement with the stay bolts so that the brake cover can be prevented from being fallen out accidentally, as mentioned above. For example, depending on the locations of the stay bolts, two recesses may be provided for three stay bolts. Likewise, in the case of five stay bolts being located, the recess need not necessarily be provided for each of them.

As shown in FIGS. 3 and 4, the wheel cover 19 includes a cover portion 52 covering the outer side of the hand wheel 11; and a leg portion 53 covering the periphery of the hand wheel 11 and extending from the cover portion 52 toward the right side plate 2, to be mounted on the right side plate 2. The cover portion 52 has a generally inverted delta shape, with each side protruding at the center part thereof and each corner being rounded. The cover portion has, at its upper corners, insertion bores 54, 55 for two stay bolt 17, 18 to be inserted, and at its lower part, an insertion bore 56 for one stay bolt 16 to be inserted.

At a center portion of the cover portion 52 are formed a first ringlike strengthening rib 57 protruding toward the hand wheel 11 and a second ring-like strengthening rib 58 protruding around the first strengthening rib 57 in the opposite direction to the first strengthening rib 57. An inner radius 59 of the first strengthening rib 57 is protruded outwardly from an outer radius 60 of the first strengthening rib 57, to well cover an axial end of the drive shaft 5. The leg portion 53 is composed of an upper leg 61 formed continuously to an upper marginal portion around the cover portion 52 between and around the two insertion bores 54, 55 for the stay bolts and a lower leg 62 formed continuously to a lower edge portion of the cover portion around the insertion bore 56 for the stay bolt at the bottom. The cover portion 52 is provided, at a portion thereof extending between the upper leg 61 and the lower leg 62, with side walls 73, 74 formed by a marginal portion around the cover portion 52 being bent toward the hand wheel 11. Two apertures, which are formed between the upper leg 61 and the lower leg 62 at the side wall 73 and at the side wall 74, respectively, are in the form of chain introducing passageways 71, 72 for introducing the hand chain therethrough.

The upper leg 61 is provided, at a free end portion thereof, with an upper abutting portion 63 extending outwardly in the same direction as the right side plate 2 so as to be abutted with the right side plate 2. Similarly, the lower leg 62 is provided, at a free end portion thereof, with a lower abutting portion 64 extending outwardly in the same direction as the right side plate 2 so as to be abutted with the right side plate 2.

The upper abutting portion 63 and the lower abutting portion 64 are formed in continuation to the upper leg 61 and the lower leg 62 by bending the free end portions of the upper and lower legs, as shown in FIGS. 4 and 5. The upper and lower legs are formed into a curved form at the bending portions 65, 66. With the marginal portion around the flange portion 46 of the brake cover 31 being abutted with inner wall surfaces of the upper and lower legs 61, 62 at the bending portions 65, 66, the brake cover 31 is held by the leg portion 53 of the wheel cover 19.

The abutment part is shown in FIG. 6, in which the upper abutting portion 63 and lower abutting portion 64 of the wheel cover 19 are shown in a phantom line. The flange portion 46 at the upper edge of the brake cover 31 and the flange portions 46 at the outer edges of the two protrusions 50, 51 abut with the inner wall surface of the upper leg 61 at the bending portion 65, and the flange portion 46 at the lower edge of the brake cover at both sides of the recess 49 abuts with the inner wall surface of the lower leg 62 at the bending portion 66.

Thus, by virtue of the brake cover being held, with the marginal portion around the flange portion 46 abutted with the inner wall surfaces of the upper and lower legs 61, 62 of the wheel cover 19, the fitting of he brake cover 31 to the right side plate 2 is further ensured.

In addition, by virtue of the upper and lower abutting portions 63, 64 being formed at the free end portions of the upper and lower legs 61, 62, respectively, the fitting of the wheel cover 19 to the right side plate 2 is further ensured. Consequently, the marginal portion around the flange portion 46 abutting with the inner wall surfaces of the upper and lower legs 61, 62 is further surely held.

Further, the structure for allowing the marginal portion around the flange portion 46 to abut against the upper and lower legs 61, 62 at the bending portions 65, 66 of curved form involves the curved parts of the wheel cover at the bending portions 65 and 66 having a given width with respect to the direction for the marginal portion around the flange portion 46 to be abutted with the inner wall surfaces of the upper and lower legs 61, 62. By virtue of this, the marginal portion around the flange portion 46 can be allowed to well abut with the inner wall surfaces of the upper and lower legs 61, 62 within the widths of the curved parts, even when the marginal portion around the flange portion 46 does not accurately contact with the inner wall surfaces of the upper and lower legs 61, 62 due to, for example, some manufacturing error involved in the wheel cover 19 and the brake cover 31. Consequently, with this embodied form of the invention, even when some manufacturing error is caused, the marginal portion around the flange portion 46 and the inner wall surfaces of the upper and lower legs 61, 62 can be well abutted with each other, so that strict design accuracy is not required for the components and accordingly the chain block can be manufactured with reduced costs.

The flange portion 46, which is formed all along the marginal portion around the brake cover 31 in the embodied form, may be modified to be formed partially.

Figure 7:
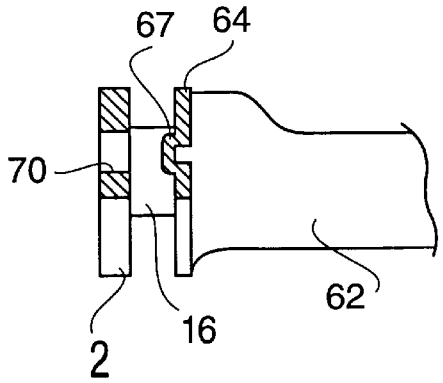
FIG. 7 is a sectional view, when viewed from the sectioning direction to be taken along line VII—VII of FIG. 2, of the fitting state of a lower leg and the right side plate.

FIG. 7 is a sectional view, when viewed from the sectioning direction to be taken along line VII—VII of FIG. 2, of the fitting state of the lower leg 62 and the right side plate 2. As shown in FIGS. 3 and 7, the lower abutting portion 64 of the lower leg 62 is formed into a broad-shouldered form extending outwardly from both sides of the insertion position of the stay bolt 16. At positions in the lower abutting portion 64 close to and symmetric with respect to the insertion position of the stay bolt 16, two knock pins 67, 68 are formed so as to project toward the right side plate 2. The knock pins 67, 68 are integrally formed by forming the lower abutting portion 64 into a convex form. Also, as shown in FIGS. 2 and 7, the right side plate 2 is provided with receiving holes 69, 70 for receiving the knock pins 67, 68 therein, at positions in opposition to the two knock pins 67, 68 formed in the lower abutting portion 64.

Fitting the both knock pins 67, 68 into the related receiving holes 69, 70 enables the lower leg 62 of the wheel cover 19 to be fitted to the side plate quickly and surely with positioned in place. This contributes to sure abutment of the marginal portion around the flange portion 46 with the inner wall surface of the lower leg 62. In addition to this, both knock pins 67, 68 fitted into the related receiving holes 69, 70 contribute to increase in strength of the lower leg 62 of the wheel cover 19, together with the stay bolt 16 close to the knock pins. Consequently, for example even when the chain block is dropped down on the ground or collides with some objects, the wheel cover 19 is prevented from being moved out of position or being deformed, thus enabling the surely fitted brake cover 31 to be well maintained. In particular, when a top portion of the wheel cover 19 collides with a foreign object, the lower leg 62 is affected to be so deformed as to be peeled off from the right side plate 2, but the lower leg 62 can then be effectively prevented from being deformed. That is because, according to the embodied form of the invention, the knock pins 67, 68 are formed at the lower abutting portion 64 of the lower leg 62 and also the receiving holes 69, 70 are formed in the right side plate 2 at positions in opposition to the knock pins 67, 68, so as to enhance the strength of the lower leg 62.

It is noted that according to the embodied form, the knock pins 67, 68 are formed at the lower abutting portion 64, while the receiving holes 69, 70 are formed in the right side plate 2 at positions in opposition to the knock pins 67, 68, but this arrangement may be modified such that the knock pins are formed in the right side plate 2 at positions in the vicinity of the insertion bore 41 for the stay bolt 16, while the receiving holes for receiving the knock pins therein are formed in the lower abutting portion 64. In addition, other than the knock pins, any projections fittable into the receiving holes may be adopted. Further, the projections and receiving holes may be formed in the upper abutting portion 63 at positions in the vicinity of the stay bolts 17, 18, other than in the lower abutting portion 46.

Also, the illustrated embodiment takes the arrangement in which the hand wheel 11 is directly screwed with the drive shaft 6, but may take a modified arrangement in which a hub is threadedly engaged with the drive shaft 6; the hand wheel 11 is rotatably supported on the hub; and an overload prevention mechanism for applying resistance to rotation of the hand wheel 11 is provided between the hub and the hand wheel 11.

What is claimed is:

1. A hand operated chain block comprising:

a load sheave supported between a pair of side plates via bearing means;

a hand wheel, located at an outside of one side plate, for driving said load sheave via a drive shaft;

a mechanical brake interposed between said load sheave and said hand wheel;

a wheel cover abutting said one side plate and being fitted to said one side plate with a plurality of stay bolts, for covering said hand wheel; and a brake cover, fitted to said one side plate, for covering said mechanical brake, wherein said brake cover is provided, at a marginal portion therearound, with a flange portion extending outwardly in the same direction as said one side plate to abut with said one side plate, and said flange portion is provided, at a marginal portion therearound, with recesses fittable to said stay bolts and having an opening end portion which opens outwardly to said one side plate.

2. A hand operated chain block according to claim 1, wherein said wheel cover is provided with legs to be fitted to said one side plate, and said marginal portion around said flange portion of said brake cover is abutted with inner wall surfaces of said legs.

3. A hand operated chain block according to claim 2, wherein said legs are each provided, at a free end portion thereof, with an abutting portion extending along the same direction as said one side plate to abut with said one side plate.

4. A hand operated chain block according to claim 3, wherein said abutting portion is formed by bending said free end portion of said each leg and also the bent portion is formed into a curved form, so as to allow said marginal portion around said flange portion to abut with said bent portion.

5. A hand operated chain block according to claim 3, wherein a projection is provided in any one of said abutting portion at a position close to said stay bolts and said one side plate at a position opposite to said position, and a receiving hole for receiving said projection therein is provided in the other.

* * * * *

UNITED STATES PATENT AND TRADEMARK OFFICE

CERTIFICATE OF CORRECTION

PATENT NO. : 6,007,054

DATED : December 28, 1999

INVENTOR(S) : Eikiti Kobayasi et al.

It is certified that errors appear in the above-identified patent and that said Letters Patent is hereby corrected as shown below:

In the drawings, Sheet 2, Fig. 2, the sectional designation "A-A" should be replaced by sectional designation --IV-IV--.

In the drawings, Sheet 2, Fig. 2, the sectional designation "B-B" should be replaced by sectional designation --VII-VII--.

The corrected drawing, Sheet 2, Fig. 2, should appear as follows:

(see next page)

Signed and Sealed this

Twelfth Day of December, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,007,054

DATED : December 28, 1999

INVENTOR(S) : Eikiti Kobayasi et al.

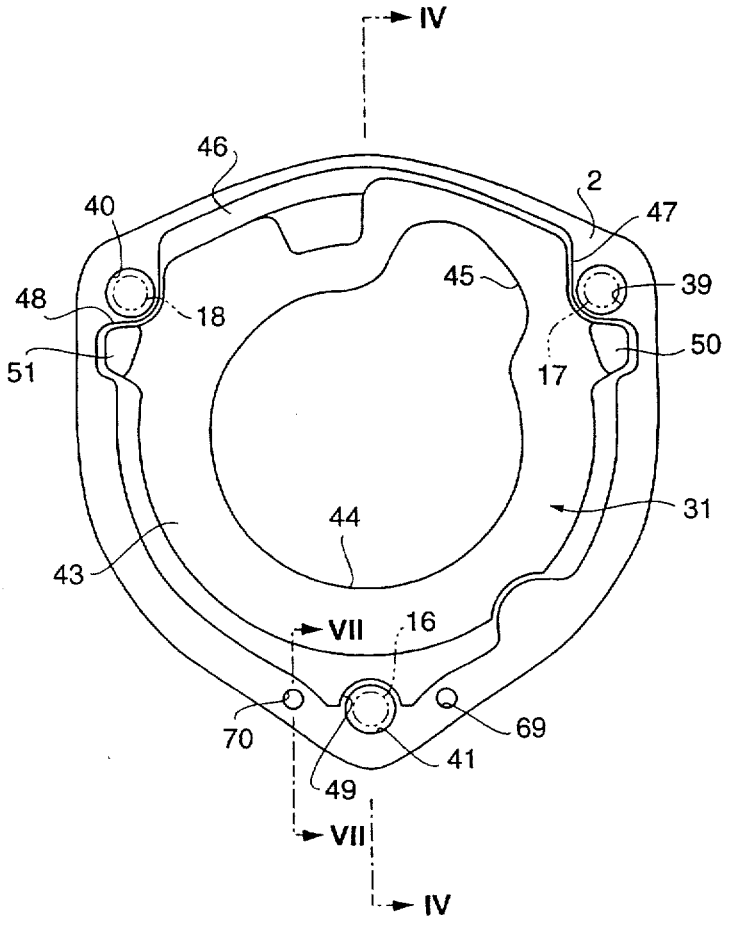

FIG. 2